United States Patent [19]

Formica et al.

[11] Patent Number: 5,057,852

[45] Date of Patent: Oct. 15, 1991

[54] PRINTHEAD FOR COLOR PRINTER PROVIDING IMAGE EDGE ENHANCEMENT

[75] Inventors: Joseph F. Formica; William E. Hunt, both of Rochester; Thomas R. Knapp, Penfield; Thomas L. Kowalczyk, Rochester, all of N.Y.

[73] Assignee: Eastman Kodak Company, Rochester, N.Y.

[21] Appl. No.: 451,852

[22] Filed: Dec. 18, 1989

[51] Int. Cl.[5] ..... B41J 2/145; B41J 2/21

[52] U.S. Cl. ..... 346/1.1; 346/140 R; 358/75

[58] Field of Search ..... 346/140 R, 75, 76 PH, 346/1.1; 358/75, 79, 80

[56] References Cited

U.S. PATENT DOCUMENTS

| | | | |
|---|---|---|---|
| 4,151,563 | 4/1979 | Gast et al. | 358/293 |
| 4,272,771 | 6/1981 | Furukawa | 346/75 |
| 4,321,610 | 3/1982 | Moore et al. | 346/108 |
| 4,623,242 | 11/1986 | Hayashi et al. | 355/14 R |
| 4,682,216 | 7/1987 | Sasaki et al. | 358/79 |
| 4,748,453 | 5/1988 | Lin et al. | 346/1.1 |
| 4,809,016 | 2/1989 | Padalino | 346/75 |
| 4,809,021 | 2/1989 | Check et al. | 346/108 |
| 4,855,752 | 8/1989 | Bergstedt | 346/1.1 |

*Primary Examiner*—Benjamin R. Fuller
*Assistant Examiner*—Victor DeVito
*Attorney, Agent, or Firm*—Warren W. Kurz

[57] ABSTRACT

Apparatus and method of producing image edge enhancement in four-color printers. The true black color is aligned for printing between the cyan, magenta, and yellow colors. When a black edge is desired, process black and true black are both used to produce the pixels along the edge. Because the process and true black pixels are interleaved with each other along the edge, the effective resolution is doubled and the sharpness is enhanced along the edge.

6 Claims, 2 Drawing Sheets

PRINTHEAD FOR COLOR PRINTER PROVIDING IMAGE EDGE ENHANCEMENT

BACKGROUND OF THE INVENTION

1. Field of the Invention

This invention relates, in general, to color printers and plotters and, more specifically, to apparatus and methods for creating a specific pixel pattern on a hard copy output medium.

2. Description of the Prior Art

Color printers, plotters, duplicators, electronic copiers, and like devices usually are limited in the sharpness they can produce on the hard copy output medium because of the resolution of the image-producing device, or printhead. Many of the printheads associated with such color machines can also print pure or true black in addition to color component or process black. However, even when using true black in a color machine, the resolution of the pixels is not usually better than that achieved when the printhead is operating in the full color mode. Thus, the overall sharpness of the produced image is largely governed by the basic resolution of the printhead.

Because true and process black pixels produce substantially the same stimuli in the observer, either system can be used to produce black in the printed image. Because of registration considerations, and for other reasons, machines capable of producing both types of black usually use true black to represent blacks in the image when possible. This produces a black which is free from colored borders caused by misregistration, but the resolution and resulting sharpness is not significantly better than that achievable with process color printing.

In order to improve the sharpness of the printed image, it is desirable, and it is an object of this invention, to provide a printhead assembly which can use both the true and process black capabilities of the printhead to effectively double the resolution of the printhead without adding to the complexity of the printhead or increasing the overall number of pixel-producing elements in the printhead.

SUMMARY OF THE INVENTION

There is disclosed herein a new and useful system for improving the resolution and sharpness of produced images from printers capable of producing color images. According to the specific embodiment described herein, a plurality of ink jet nozzles are contained within a movable printhead. Separate nozzles for the colored inks of cyan, magenta, and yellow are aligned in the direction of travel of the printhead so that they may produce a single pixel having a process color or, in a special case, process black. Nozzles for depositing true black ink on the hard copy output medium are interleaved between the colored nozzles on the printhead. When making a black edge in the image, both process black and true black are used by the printhead to produce the pixels along the edge. Because of the interleaved nature of the nozzles, this doubles the resolution of the printhead compared to prior art techniques wherein the four colors were all in alignment. Doubling the resolution enhances the sharpness of the edge in the image.

In another embodiment of the invention, enhancement of color edges is possible by interleaving the true black pixels between the process color pixels produced by the color nozzles of the printhead. This form of enhancement is possible when the resulting color produced by the color nozzles is not objectionably changed by the interleaving of the black pixels. Compensation for the black pixels can be made by locally lightening the color produced by the color nozzles near the edge.

In either process color or process black representation of the image edge, the interleaving of the black pixels therebetween increases the resolution and improves the sharpness of the image edge without increasing the number of nozzles or applicator areas over conventional four-color printhead structures. Although described in connection with ink jet printers, the invention herein may also be practiced with pen plotters, impact printers with color ribbons, and electrostatographic apparatus using other types of exposing apparatus which is capable of producing true black pixels interleaved with color pixels.

BRIEF DESCRIPTION OF THE DRAWINGS

Further advantages and uses of this invention will become more apparent when considered in view of the following detailed description and drawings, in which.

DESCRIPTION OF THE PREFERRED EMBODIMENTS

Figure 1:
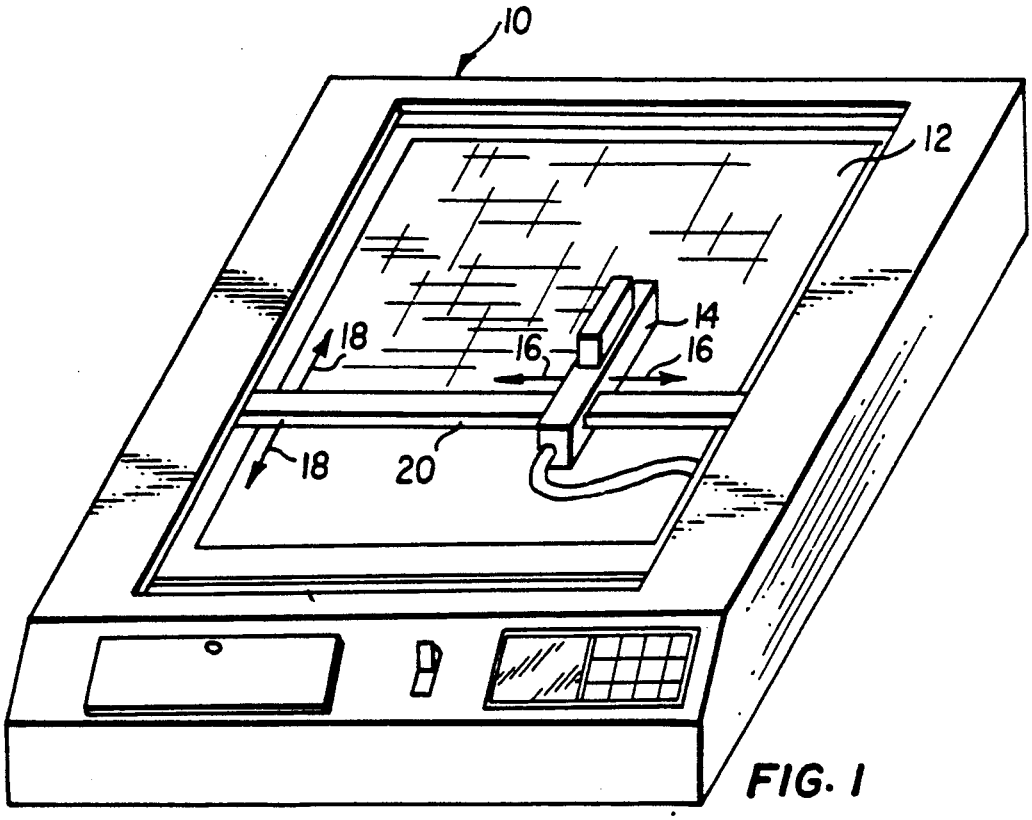
FIG. 1 is a view illustrating a color printer of the type wherein the invention may be used.

Throughout the following description, similar reference characters refer to similar elements or members in all of the figures of the drawings.

Referring now to the drawings, and to FIG. 1 in particular, there is shown apparatus of the type which uses the teachings of this invention. The printer 10 is capable of producing images and text on the paper sheet 12 by appropriately scanning the printhead 14 in the directions indicated by the arrows or directions 16 and 18. The printhead 14 moves in directions 16 across the carrier or guide member 20 which can be moved in directions 18 to provide the two-axis movement necessary to cover the entire sheet 12. Although illustrated in an application which produces images, text, and graphic material on the sheet 12 with a structure normally associated with pen plotters, it is to be understood that the invention herein concerning the particulars of the printhead 14 can be used with other types of apparatus. For example, the invention may be used with printers which scan in a single direction across sheets of paper which are moved relative to the printhead in a perpendicular direction by a suitable tractor or roller, as is common in many types of printers.

In the specific embodiment of the invention shown in FIG. 1, the printhead 14 is of the ink jet type wherein fine droplets of ink are deposited on the sheet 12 from separate nozzles or openings in the printhead structure. Other types of printhead structures may be used within the contemplation of the invention, such as ink pen printheads and printheads using impact pins and colored ribbons. Whatever the arrangement of the printhead, the invention relies on the fact that the printhead can produce both true black and process black or color on the hard copy medium, and it is the specific arrangement of the true black and process black pixels on the medium which provides the advantages of the invention. It is also possible to use other forms of image production on hard copy mediums which produce the desired technique taught by this invention, such as electrophotographic apparatus which uses LED or laser printheads and electrostatographic apparatus which uses styli to create a latent image.

Figure 2:
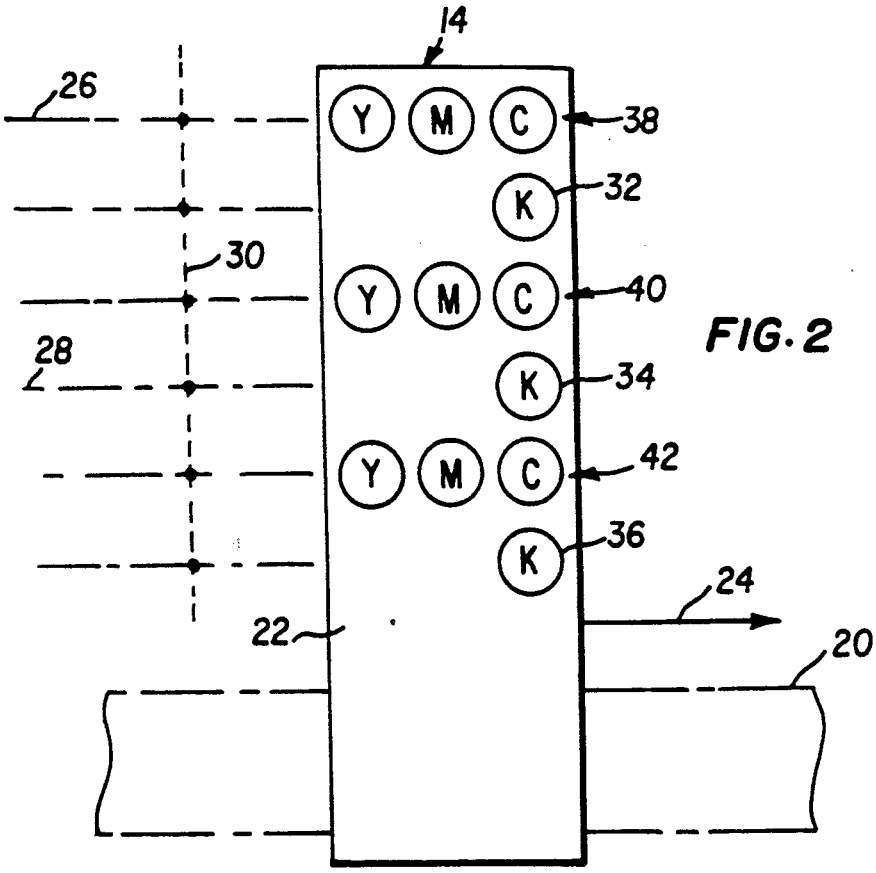
FIG. 2 is a schematic diagram of a color printhead constructed according to this invention.

FIG. 2 is a schematic diagram of a color printhead constructed according to the ink jet embodiment of the invention. The carrier structure 22 of the printhead 14 supports the individual ink jet nozzles and is movable on the member 20 in direction 24 so that the paper sheet underneath the printhead can be appropriately printed or covered with ink to produce the desired image. The dashed lines, such as lines 26 and 28, indicate the axis or path which has been covered by the corresponding ink jet nozzles. Consequently, the pixels produced by the corresponding ink jet nozzle are centered on one of the dashed lines. The dashed line 30 represents the location of a single linear row where pixels can be aligned to produce an image edge, as will be discussed in more detail in connection with other figures of the drawings.

The printhead 14 includes a plurality of ink jet nozzles which are capable of producing, directly upon the hard copy medium, color images, process black images, and true black images. Shown schematically as to the effective application area of the particular color, the nozzles 32, 34 and 36 are adapted to deposit black (K) ink on the hard copy medium. The color nozzles 38, 40 and 42 are positioned in-line with each other in the direction of travel of the printhead 14 and deposit the cyan (C), magenta (M), and yellow (Y) inks on the hard copy medium. Although illustrated with the black nozzles at the same horizontal position as the cyan nozzles, it is within the contemplation of the invention that other configurations may be used, such as having the black nozzles not in vertical alignment with any of the color nozzles.

By conventional practice, which is well known in the prior art, the control apparatus of the printer can vary the amounts of the three color inks such that a wide range of colors can be produced on the sheet. In a special case, the three colors can be properly combined to form process black on the hard copy medium. As can be seen from FIG. 2, the color nozzles 38, 40 and 42 are positioned in an interleaved or staggered pattern with the black nozzles 32, 34 and 36. It is this staggered arrangement of the rows of color and true black nozzles which allows the printed pixels to align along the line 30 in a fashion which improves the sharpness of an edge along this line over prior art apparatus, even without increasing the number of ink jet nozzles attributed to the printhead.

Figure 3:
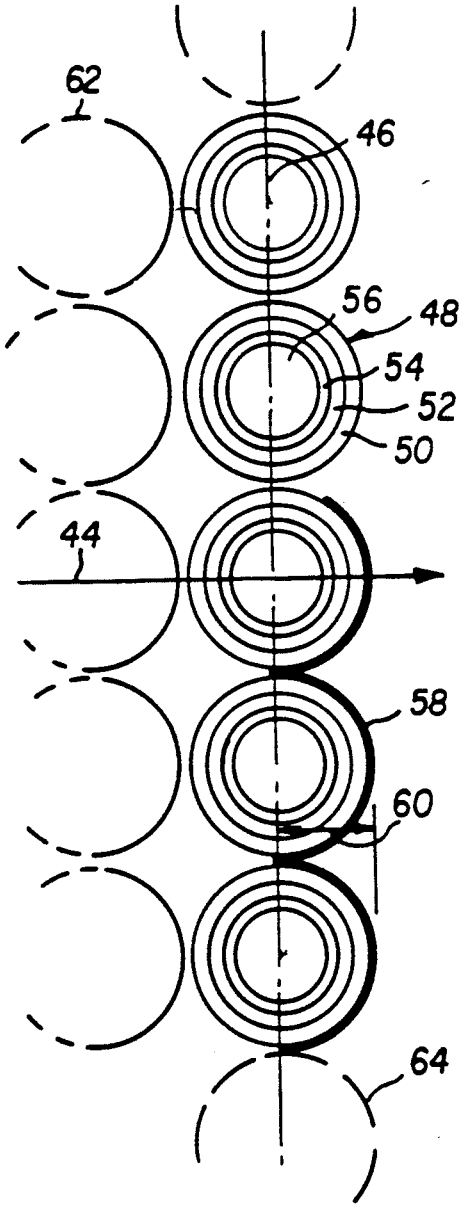
FIG. 3 (prior art)
FIG. 3 illustrates a printed pixel arrangement produced by a prior art printhead.

According to the prior art, the true black ink jet nozzles are traditionally in line with the colored nozzles. The effective result of such an arrangement is illustrated in FIG. 3. With arrow 44 indicating the direction of scan of the printhead, the pixels produced along the row or line 46, which is similar to the row or line 30 in FIG. 2, are as illustrated. For example, pixel 48 is composed of color layers 50, 52 and 54 and black layer 56. The differences in the diameters of the layers is for illustrative purposes only and does not necessarily correspond to the amount of ink deposited to form the pixel. The main point is that the true black and the color inks according to prior art printheads are aligned with each other. Of course, a process black pixel can be produced by just using ink layers 50, 52 and 54. On the other hand, a true black pixel can be produced by just using ink layer 56. In typical applications, process black pixels are usually replaced with true black pixels.

Regardless of the colors used, the spacing between the pixels, or the resolution of the printhead, is unchanged. Therefore, a row of black pixels along the line 46, either true black, process black, or some combination thereof, has a definite resolution and the lack of smoothness of the edge, as depicted by line 58, is a result of this pixel resolution. As can be seen in FIG. 3, the amplitude or variation 60 of line 58 is considerable in the case of the resolution provided by prior art printheads which have the true black and the color jets aligned with each other in the scan direction of the printhead. Other pixels formed in the image are represented by phantom pixel areas in FIG. 3, such as phantom pixels 62 and 64. Although illustrated as small pixel areas, it is understood that the nozzles may produce lines of printed ink when the previous pixels are the same color.

Figure 4:
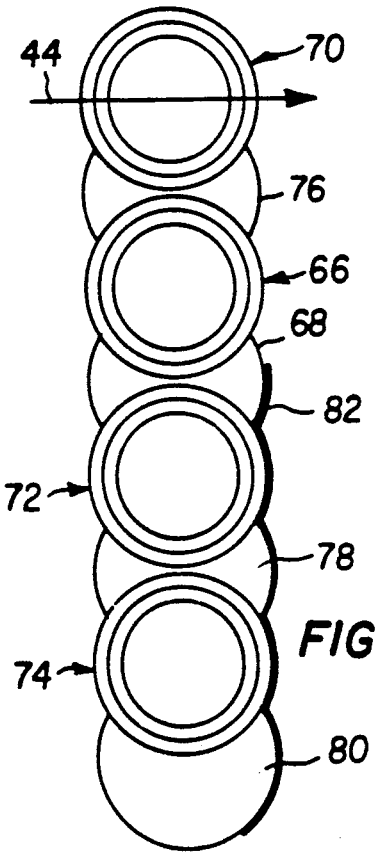
FIG. 4 illustrates a black printed pixel arrangement produced by the printhead of this invention.

FIG. 4 illustrates a row of printed pixels which would be produced by the printhead of this invention. Pixel 66 represents a process black pixel which is produced by the three color ink jet nozzles in the printhead, such as color nozzles 40 shown in FIG. 2. Pixel 68 represents a true black pixel produced by a single black nozzle in the printhead, such as nozzle 34 shown in FIG. 2. Additional process black pixels 70, 72 and 74 and additional true black pixels 76, 78 and 80 are shown in FIG. 4. Because of the interleaved nature of the process and true black pixels along the same row of the image edge, the resolution of the printhead in the black mode is enhanced without increasing the number of printhead nozzles over the prior art arrangements. Consequently, the line 82 which defines the black edge of the printed pixels has less amplitude and variation than the line 58 shown in FIG. 3, thereby producing an enhanced and sharper image edge in the cross-scan direction. A sharper edge in the "in-track" direction can be achieved by "half-stepping" or varying the time the pixels are printed. It is emphasized that other numbers of nozzles in the printhead may be used than that shown in this specific embodiment of the invention. The important point is that they be interleaved to produce the interleaved pattern of true black and process black pixels shown in FIG. 4 along the edges of text and graphic lines in the printed image.

Figure 5:
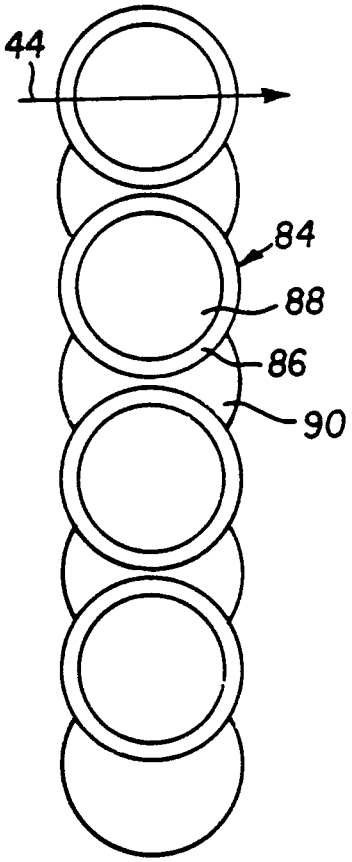
FIG. 5 illustrates a colored printed pixel arrangement produced by the printhead of this invention.

The invention disclosed herein is also applicable to enhancing the image edges of certain color images. For example, when a particular color is being printed at the edge of an image, interleaving pure or true black pixels with the color pixels can improve the sharpness of the edge without disrupting the desired color if suitable processing is used. For example, in FIG. 5, the colored pixel 84 consists of the color inks 86 and 88 which are combined to provide a desired color. If this desired color is relatively dark, the addition of the true black pixels, such as pixel 90, between the color pixels would not materially change the appearance of the color produced by the pixels 84. With suitable processing, the colors produced in the color pixels can be lightened to compensate for the darkness provided by the black pixels being added. Therefore, the advantages of this invention are also realizable when it is desired to enhance the edge sharpness in images produced by colored pixels by introducing interleaved true black pixels between the colored pixels.

There has been disclosed herein a system for printing true black pixels in between process black and colored pixels for enhancing the resolution of the printed image edge in the cross-scan direction. It is emphasized that numerous changes may be made in the above-described system without departing from the teachings of the invention. It is intended that all of the matter contained in the foregoing description, or shown in the accompanying drawings, shall be interpreted as illustrative rather than limiting.

We claim as our invention:

1. A printhead for producing edge-enhanced images on a print medium during relative movement between said printhead and print medium in a printing operation, said printhead comprising:

a) a first plurality of pixel-forming means for selectively producing true black pixels along a linear image line extending transverse to a direction of said relative movement; and b) a second plurality of pixel-forming means for selectively producing process black pixels along said linear image line, said first and second plurality of pixel-forming means being interleaved to provide alternating true black and process black pixels along said linear image line.

2. The printhead as defined by claim 1 wherein said second plurality of pixel-forming means are arranged in discrete groups of different color pixel-forming elements, the elements in each of said groups being arranged in a linear array extending in a direction parallel to the direction of said relative movement.

3. The printhead as defined by claim 2 wherein said different color pixel-forming elements are adapted to form yellow, cyan and magenta colored pixels in registration during said relative movement.

4. The printhead as defined by claim 1 wherein said first and second pixel-forming means comprise means for producing droplets of ink on said print medium.

5. A method of printing edge-enhanced images on a print medium, said method comprising the steps of:

a) providing a printhead comprising (i) a first plurality of selectively energizable pixel-forming elements for producing true black pixels along a linear image line; and (ii) a second plurality of selectively energizable pixel-forming elements for producing process black pixels along said linear image line, said first and second plurality of pixel-forming elements being interleaved to provide alternating true black and process black pixels along said linear image line; and b) producing relative movement between said printhead and print medium.

6. The method as defined by claim 5 wherein said different colored pixels comprise yellow, cyan and magenta pixels.

* * * * *